United States Patent [19]

Batten

[11] Patent Number: 4,830,387

[45] Date of Patent: May 16, 1989

[54] BOAT CARRIER

[76] Inventor: Charlie A. Batten, 6701 Rhode Island Ave., College Park, Md. 20740

[21] Appl. No.: 85,720

[22] Filed: Aug. 17, 1987

[51] Int. Cl.[4] ..... B62B 3/06

[52] U.S. Cl. ..... 280/47.331; 280/414.3; 280/38; 280/40; 414/460; 114/343; 114/366

[58] Field of Search ..... 280/47.13 B, 414.1, 280/414.2, 414.3, 35, 38, 40, 47.14, 39; 414/458, 459, 460, 495; 114/344, 343, 365, 366, 220, 44

[56] References Cited

U.S. PATENT DOCUMENTS

| | | | |
|---|---|---|---|
| 929,560 | 7/1909 | Collier | 280/39 |
| 2,476,188 | 7/1949 | Griffin | 414/459 |
| 2,603,501 | 7/1952 | Graves | 414/460 X |
| 2,848,243 | 8/1958 | Young | 280/47.13 B |
| 3,068,024 | 12/1962 | Berliner | 280/47.13 B |
| 3,164,392 | 1/1965 | Lane | 280/47.13 B |
| 3,616,474 | 11/1971 | Lindblad | 280/47.13 B |
| 4,579,357 | 4/1986 | Webster | 280/47.13 B |

*Primary Examiner*—Charles A. Marmor
*Assistant Examiner*—Tamara L. Finlay
*Attorney, Agent, or Firm*—Brady, O'Boyle & Gates

[57] ABSTRACT

A boat carrier wherein a wheel supported frame is detachably connected to the existing oar lock apertures provided in the gunwhales of the boat, whereby the boat may be easily transported by one person. The wheel supported frame may also be folded to an inoperative position for storage.

1 Claim, 2 Drawing Sheets

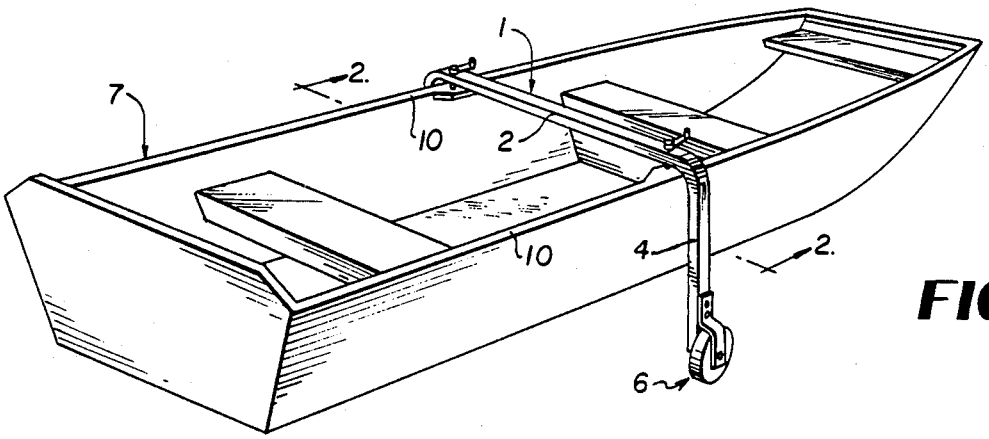
FIG. 1
FIG. 2
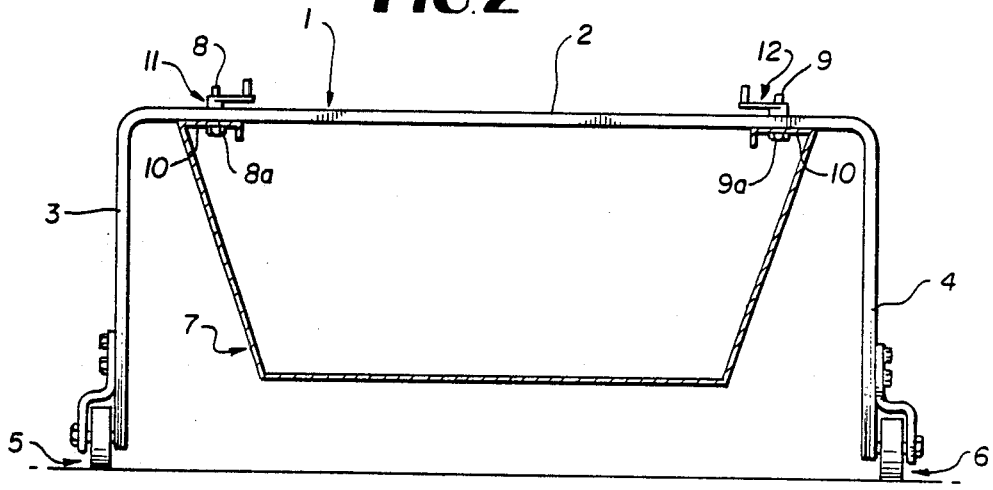
FIG. 3
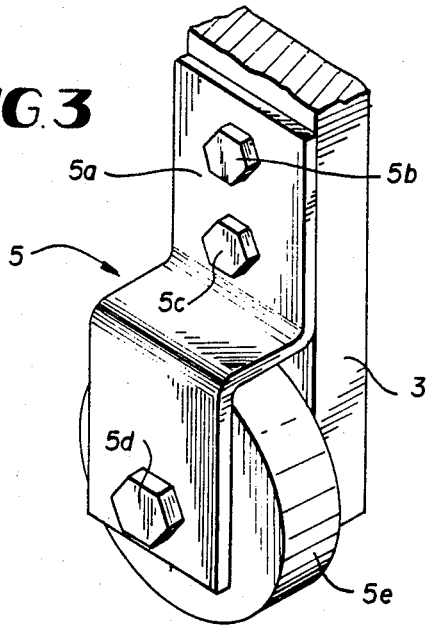
FIG. 4
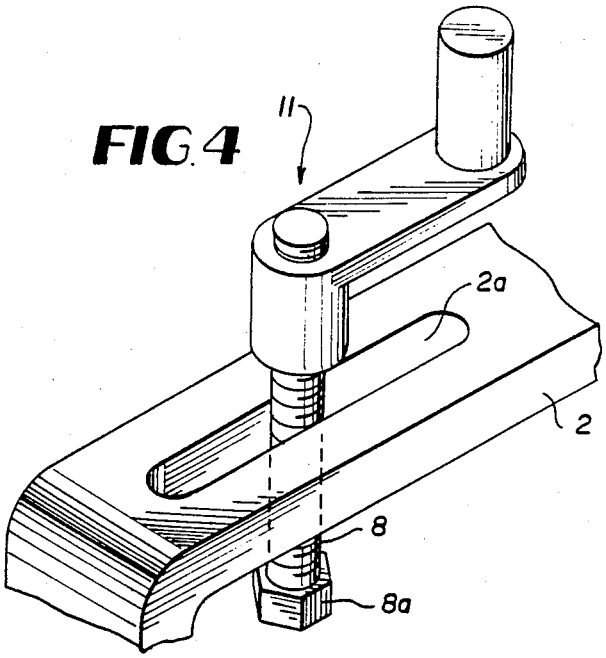

FIG. 5
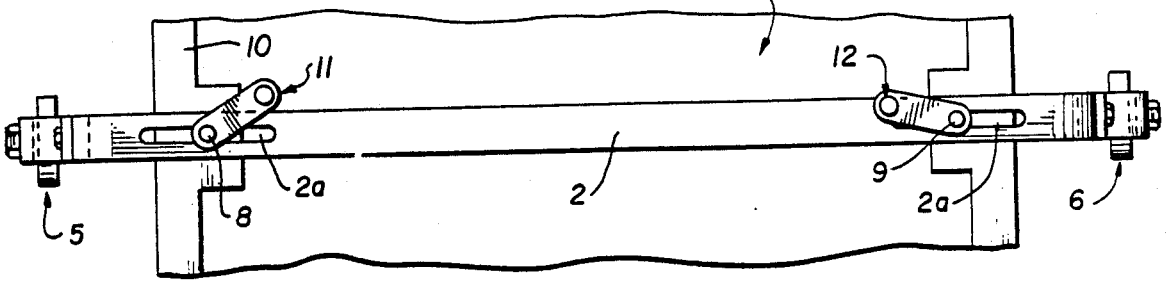
FIG. 6
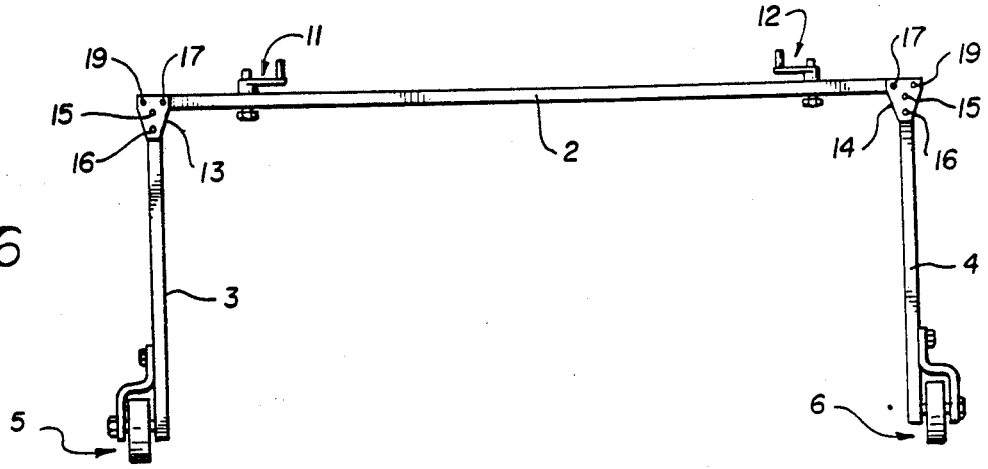
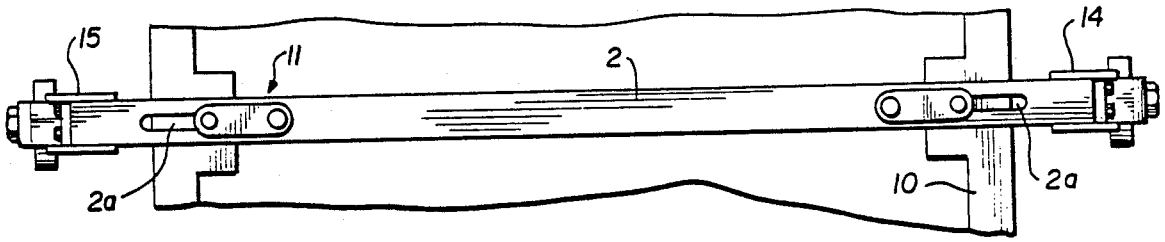
FIG. 7
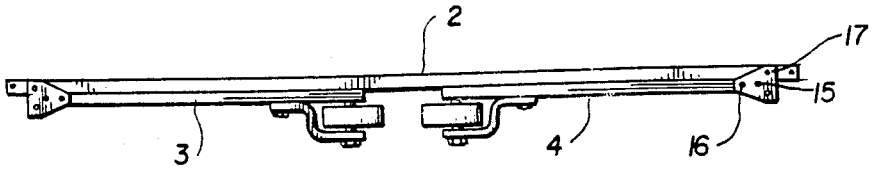
FIG. 8

BOAT CARRIER

BACKGROUND OF THE INVENTION

Various wheeled boat carriers have been proposed for manually transporting small boats to and from the water's edge. While these carriers have been satisfactory for their intended purposes, they have certain inherent disadvantages, such as, requiring the boat to be transported in an upside-down position, thereby requiring a lifting of the boat by a person using the carrier to orient the boat in the upside-down position. Other carriers have required special fasteners to secure the carrier frame to the boat.

After considerable research and experimentation, the boat carrier of the present invention has been devised to overcome the disadvantages experienced with other small boat carriers, and comprises, essentially, a wheeled frame including a transversely extending member having a wheel journaled thereon, and a pair of depending bolts and associated crank nuts mounted on the transverse frame member. The bolts are adapted to extend upwardly through the existing oar lock holes provided in the boat's gunwhales and by tightening the crank nuts on the bolts the boat is lifted off the ground and supported by the wheeled frame.

By the construction and arrangement of the wheeled carrier of the present invention, special fasteners are not required to secure the carrier to the bolt and it is not necessary for the boat to be lifted and turned to an upside-down position.

BRIEF DESCRIPTION OF THE DRAWINGS

FIG. 1 is a perspective view of one embodiment of the carrier of the present invention mounted on a boat;

FIG. 2 is a view taken along line 2—2 of FIG. 1;

FIG. 3 is an enlarged perspective view of one of the wheels of the carrier;

FIG. 4 is an enlarged perspective view of the bolt and crank nut employed for securing the carrier to the boat;

FIG. 5 is a top plan view of the carrier shown in FIG. 1;

FIG. 6 is an elevational end view of another embodiment of the carrier of the present invention;

FIG. 7 is a top plan view of the carrier shown in FIG. 6; and

FIG. 8 is an elevational end view showing the carrier of FIG. 6 in the folded position.

DESCRIPTION OF THE PREFERRED EMBODIMENT

Referring to the drawings and more particularly to FIGS. 1 and 2, the boat carrier 1 of the present invention comprises, a wheeled frame having a transversely extending member 2 integrally connected at its opposite ends to a pair of depending leg members 3 and 4, having wheels 5 and 6 journaled on the lower ends thereof.

The carrier 1 is employed for manually transporting a small, flat bottom boat 7 having a length in the range of 10 to 14 feet, and a width of 44 to 56 inches. To connect the carrier to the boat, a pair of bolts 8 and 9 extend upwardly through the existing oar lock holes formed in the boat gunwhales 10, through the transversely extending frame member 2 and threadably secured to a pair of crank nuts 11 and 12. By tightening the crank nuts 11 and 12 onto the bolts 8 and 9, the boat 7 is lifted off the ground as shown in FIG. 2 and can be manually pushed for transporting the boat into or out of the water.

The details of the construction of one of the wheels 5 is shown in FIG. 3 wherein it will be seen that a bracket 5*a* is bolted as at 5*b*, 5*c* to the lower end of the leg 3 and another bolt 5*d* extends through the bracket and wheel 5*e* forming an axle for the wheel. The bolts 5*b*, 5*c* and 5*d* are aligned, as shown, to facilitate the fabrication of the bracket during the drilling of the respective holes for the bolts.

As will be seen in FIG. 4, the bolt 8 extends upwardly through a slot 2*a* provided in the transverse member 2; similarly, the bolt 9 also extends upwardly through a respective slot 2*a* in the frame member 2, as shown in FIG. 5, whereby the carrier 1 can be accommodated on boats of various widths. When in the operative position, the boat gunwhale 10 is interposed the bolt heads 8*a*, 9*a* and the lower surface of the transverse frame member 2, as shown in FIG. 2.

While the legs 4 of the carrier shown in FIG. 2 are fixedly or integrally connected to the transverse frame member 2, FIGS. 6 to 8 illustrate another embodiment of the invention, wherein the legs 3 and 4 are pivotally connected to the transverse frame member 2, to thereby facilitate folding the carrier for storage. To this end, a pair of brackets 13 and 14 are fixedly secured as at 15 and 16 to the upper end of the legs 3 and 4. Each bracket is pivotally connected to the transverse frame member 2 as at 17 and secured thereto in the operative position by removable pins 19. To fold the carrier to the position shown in FIG. 8, pins 19 are removed from the brackets 13 and 14, and the legs 3 and 4 are pivoted about pivot 17.

From the above description, it will be readily apparent to those skilled in the art that the boat carrier of the present invention can be easily connected to and removed from a small boat by one person without requiring undue manipulation of the boat, and the simplicity of the construction of the carrier facilitates the fabrication and replacement of the various components.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A boat carrier comprising a wheeled frame including a frame member extending transversely of the longitudinal axis of the boat to be carried, a pair of depending legs connected to opposite ends of said transversely extending frame member and positioned on opposite sides of the boat, whereby the wheeled frame straddles the boat to be transported, a wheel connected to the lower end of each leg, oar lock holes provided in the boat gunwhale, a pair of bolts having heads extending upwardly through said oar lock holes and through the transversely extending member, each bolt head engaging the portion of the boat gunwhale surrounding the respective oar lock hole, and crank nuts threadably mounted on the upper ends of the bolts, whereby upon tightening the crank nuts on the bolts the boat is lifted off the ground and supported by the wheeled frame with the boat gunwhale interposed the bolt heads and the lower surface of the transversely extending frame member, to thereby facilitate the manual transportation of the boat, elongated slots provided in the transversely extending member through which the bolts extend, whereby the wheeled frame can accommodate boats of various widths, a bracket fixedly connected to the upper end of each leg, a pivot pin extending through each bracket and the respective end of the transversely extending member, to thereby pivotally connect each leg to the respective end of the transversely extending member, whereby the legs can be pivoted inwardly underneath the transversely extending frame member for folding the boat carrier for storage, and a removable pin extending through each bracket and the transversely extending member for holding the legs in the depending, operative position.

* * * * *